United States Patent [19]

Barouh et al.

[11] 4,126,842

[45] Nov. 21, 1978

[54] TOROIDAL DEFLECTION WINDING FOR CATHODE RAY TUBE HAVING IN-LINE GUNS, WIDE DEFLECTION ANGLE AND LARGE SCREEN

[75] Inventors: Roger Barouh, Acheres; Alex Nissen, Paris, both of France

[73] Assignee: GTE Sylvania Incorporated, Stamford, Conn.

[21] Appl. No.: 819,287

[22] Filed: Jul. 27, 1977

[30] Foreign Application Priority Data

Aug. 12, 1976 [FR] France ..... 76 24595

[51] Int. Cl.[2] ..... H01F 5/00

[52] U.S. Cl. ..... 335/213; 335/210

[58] Field of Search ..... 335/210, 213

[56] References Cited

U.S. PATENT DOCUMENTS 3,688,156 8/1972 Utsunomiya et al. ..... 335/213 X 3,731,241 5/1973 Coupland ..... 335/213

*Primary Examiner*—George Harris

*Attorney, Agent, or Firm*—Theodore D. Lindgren

[57] ABSTRACT

A toroidal vertical deflection winding for use with a yoke designed for a large screen, color cathode ray tube having in-line guns and a wide deflection angle, the winding constructed to achieve deflection and self-convergence of the electron beams over the entire screen of the tube without coma effect, the winding comprised of a frustrum-shaped magnetic core with three quarter-section primary clusters of toroidally wound conductors formed thereon in predetermined arcs, the conductors of at least one of said primary clusters being non-radially wound, said conductors being positioned generally geometrically parallel to each other and said primary clusters having substantially predetermined numerical conductor relationship.

7 Claims, 10 Drawing Figures

TOROIDAL DEFLECTION WINDING FOR CATHODE RAY TUBE HAVING IN-LINE GUNS, WIDE DEFLECTION ANGLE AND LARGE SCREEN

BACKGROUND OF THE INVENTION

The invention relates generally to color television receivers, and more particularly to an electron beam deflection system for color cathode ray tubes having three guns located in-line in the tube neck, a wide deflection angle and a large phosphor screen.

Deflection yokes are commonly arranged on the cathode ray tube neck for the purpose of generating magnetic fields which act on the electron beams to cause the beams to scan the whole phosphor screen of the tube. The deflection yokes commonly have two windings wound on at least one ferrite core, one winding acting for horizontal deflection and the other acting for vertical deflection. Deflection windings are classified into two general types according to their form, namely, the saddle type and the toroidal type. The type chosen for use depends upon the design of the associated deflection circuits to which they are connected, each type having advantages and disadvantages corresponding to a particular application.

To achieve the deflection and the self-convergence of the electron beams over the total area of the phosphor screen, the deflection yoke must generate, at least in the section nearest to the screen, herein called front of the yoke, a non-uniform magnetic field which is pincushion-shaped for horizontal deflection, and which is barrel-shaped for vertical deflection.

In general, the center electron beam does not receive the same deflection force as the two side electron beams because the two side beams are nearer to the deflection coils than said center beam. Therefore, the center beam deflection is not the same as that of the side beams. This phenomenon is commonly called the coma effect. Obviously, the coma effect increases with the width of the phosphor screen, and becomes very noticable on, for example, a 26-inch phosphor screen. Correction of this effect can be achieved by several methods depending upon the type of cathode ray tube used. For example, when utilizing a small neck cathode ray tube, i.e. 28 mm diameter at the gun end, a magnetic shunt may be located inside the glass of the tube to decrease the force of the deflection fields on the side beams and thereby correct the coma effect. When utilizing a large neck cathode ray tube, i.e. 36 mm diameter at the gun end, a magnetic shunt may be located outside of the glass of the tube and behind the deflection yoke. With the foregoing modifications, classical toroidal deflection yokes have been used to achieve self-convergence without coma effect. But the foregoing solutions require relatively large volumes of space due to the added tube neck-components.

Another solution used in the prior art to achieve beam self-convergence without coma effect is modification of the magnetic field distribution between the front and the back of the deflection yoke, for instance by manufacturing a deflection yoke having two or more axially positioned ferrite cores on which the coils are separately wound, generating in the back of the yoke a magnetic field to compensate for coma effects, and in the front of the yoke a magnetic field for deflection and for self-convergence. However, this latter solution is relatively expensive.

Prior art solutions to the problem also includes the design of a deflection yoke having saddle-shaped coils with conductor distribution positioned on a ferrite core to provide a magnetic field shape for deflection and self-convergence in the front of the yoke and for correction of the coma effect in the back of the yoke. However, the required precise location for each turn of each coil slows production and otherwise increases costs.

A magnetic field having different distributions at the front and rear parts of the yoke may also be generated by using a ferrite core with a periphery taking the form of curves of varying radii of curvature. The use of such a ferrite core is also expensive.

Another method for modifying the magnetic field distribution is through use of a deflection yoke which has a plurality of separate windings, each winding having a like number of turns toroidally wound in a generally axial direction, and with a predetermined spaced relation about the periphery of the annular magnetic core. The individual windings may be interconnected to form three groups of windings, one group of which is connected to a horizontal deflection current source, one group to a vertical deflection current source and the third group to both the horizontal and vertical deflection current sources. Briefly, the toroidal yoke may have as many as 22 windings having an equal number of turns and connected to a supply bridge network. The design requires a complicated supply network for varying the magnetic field and is limited to use with a small phosphor screen where the coma effect correction is not required.

SUMMARY OF THE INVENTION

This invention disclosed an economical design for a toroidal deflection winding which corrects for coma effect and at the same time achieves deflection and self-convergence of the electron beams. The winding is suitable for use with a wide deflection angle color cathode ray tube having electron guns located in-line and having a large phosphor screen. The deflection winding is comprised of a plurality of turns clusters wound on an annular, frustrum-shaped core. At least some of the turns clusters are wound in a non-radial way such that the turns of one of said clusters form substantially the same predetermined angle with respect to one of the lines generating the frustrum of the cone of the electromagnetic core. The individual turns of said clusters are positioned generally geometrically parallel to each other within eack package. Therefore, the turns clusters may be wound using classical methods for winding toroidal cores. The exact location of the non-radial turns clusters may be achieved during winding by using a ferrite core having notches formed on its edges or by using a cogged crowns placed over said edges. In the first preferred embodiment, there are three non-radial turns clusters located on each quarter section of the toroid with turns ratios of approximately 48, 25 and 7. In a second preferred embodiment, there are four turns clusters located on each quarter section of the toroid, two of which are wound in a classical radial way and having a turns ratio of approximately 25 to 7 and two of which are wound in a non-radial way having a turns ratio of approximately 41 to 7. In a third embodiment, the two non-radial clusters of the second embodiment are combined into one non-radial turns cluster.

DESCRIPTION OF THE PREFERRED EMBODIMENTS

For a better understanding of the present invention, together with other and further objects, advantages and capabilities thereof, reference is made to the following disclosure in conjunction with the accompanying drawings.

To achieve the self-convergence of the three in-line electron beams over the entire phosphor screen, the deflection windings must generate non-uniform magnetic fields. More specifically, the magnetic field in the front part of the horizontal deflection winding should be pincushion-shaped and the magnetic field in the back part should be barrel-shaped.

Figure 1:
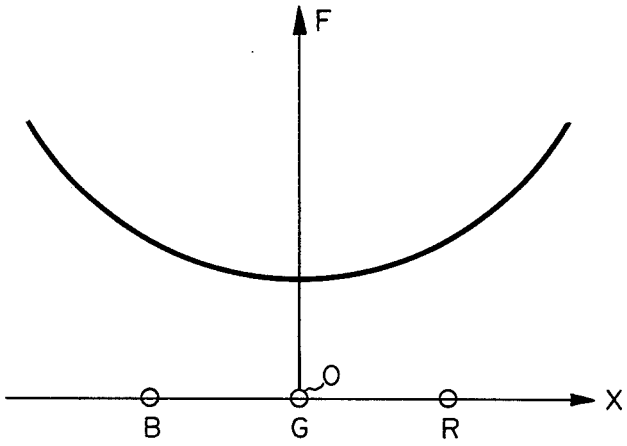
FIG. 1 indicates a typical curve of vertical deflection force amplitude as function of the distance perpendicular to the electron beams.

In general, the amplitude of the electromagnetic force on a particular beam varies with the distance of that beam from the yoke. The graph of FIG. 1, on which 0 is the yoke axis, and B, G and R are the three electron beam locations, indicates the deflection force amplitude as function of the yoke diameter. It is apparent from the figure that the applied forces on the side beams are greater than the force on the center beam because of the non-uniform force across the yoke diameter. Therefore, the B and R beams are deflected to a greater extent than the G beam. This phenomenon is called the coma effect.

To correct the coma effect, a pincushion-shaped field is generated in the back or gun-end of the vertical deflection winding and a barrel-shaped field is generated in the back or gun-end of the horizontal deflection winding.

Figure 2:
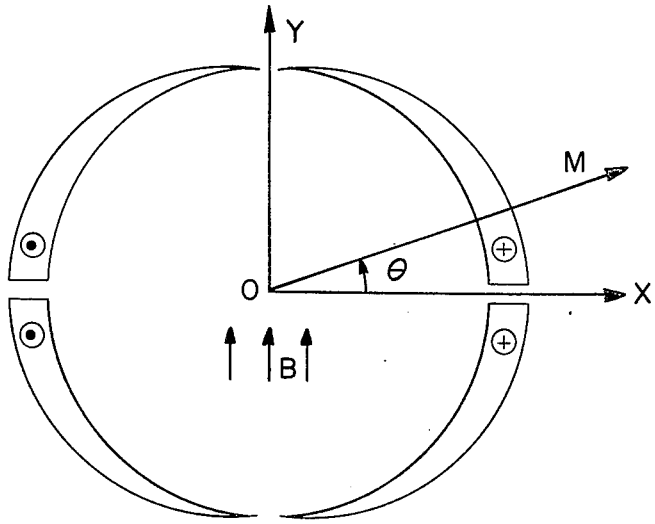
FIG. 2 is a diagrammatic view of the section showing a conductor distribution for a conventional radially wound saddle-shaped horizontal deflection winding.

For example, a hybrid deflection yoke, which ordinarily uses saddle-shaped coils for horizontal deflection to minimize radiation and to adapt impedance to supply networks, would have conductors distributed so that the generated field is pincushion-shaped at the front of the yoke and barrel-shaped at the back of the yoke. Referring to FIG. 2, there is shown a typical distribution of conductors for a typical horizontal deflection saddle-shaped winding (or distribution for the turns of a typical horizontal deflection toroid winding) where line OM is radiusvector, O representing the longitudinal axis of the core, OM making an angle $\theta$ with OX axis or horizontal plane passing through said core axis. Also indicated are instantaneous current and magnetic flux directions.

The cumulative sum of the conductor distribution, $N_h(\theta)$, is typically given by the formula:

$$N_h(\theta) = N_{1h} \sin \theta + N_{3h} \sin 3\,\theta,$$

where $N_{1h}$ and $N_{3h}$ are the first and third order coefficients of the Fourier series for which the even coefficients are all zero and for which coefficients of order greater than three are negligible with respect to $N_{3h}$, even though they may have relative importance for the picture quality.

It is well known that if $N_{3h}$ is positive, the generated magnetic field is pincushion-shaped and if it is negative, the field is barrel-shaped. Therefore, when the magnetic field is is pincushion-shaped, there are relatively few conductors positioned at values of $\theta$ near $\pi/2$ radians, and there are a relatively large number of conductors positioned at values of $\theta$ near zero radians, the maximum conductor density being higher near zero radians than for a uniform field. Inversely, when the magnetic field is barrel-shaped, the number of conductors for $\theta$ near $\pi/2$ radians is greater than for a uniform field, and for $\theta$ near zero radians there are fewer conductors. To achieve self-convergence without coma effect, the conductor distribution must be such that the electron beam passes from a barrel-shaped field to a pincushion-shaped field as it passes through the magnetic core of the horizontal deflection winding.

For the same reasons, the vertical deflection conductor distribution must generate a pincushion-shaped field at the back of the yoke and a barrel-shaped field at the front of the yoke.

Figure 3:
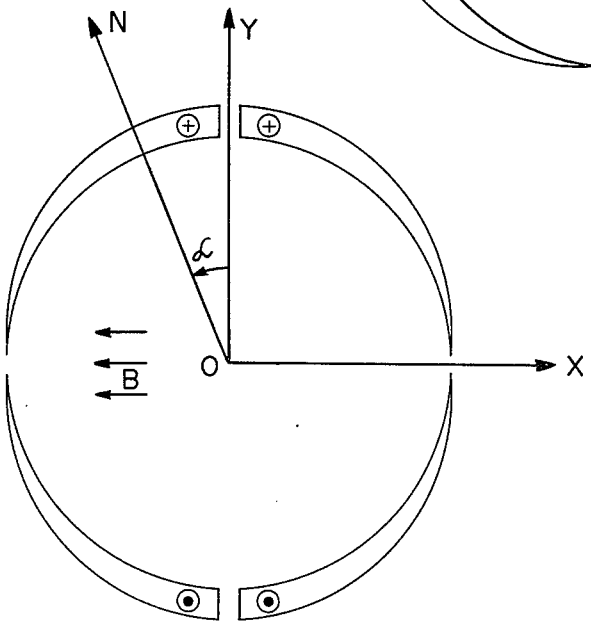
FIG. 3 is a diagrammatic view of the section showing a conductor distribution for a conventional radially wound saddle-shaped vertical deflection winding.

Referring to FIG. 3, a typical distribution of conductors for a vertical deflection saddle-shaped winding or for the internal part of a toroid winding is indicated. It can be seen that this diagram is identical to that of FIG. 2, but with a counterclockwise rotation of $\pi/2$. The cumulative sum of the conductor distribution, $N_v(\alpha)$, is typically given by the formula:

$$N_v(\alpha) = N_{1v} \sin\alpha + N_{3v} \sin 3\alpha$$

where $N_{3v}$ is positive for a pincushion-shaped field and negative for a barrel-shaped field and with $\alpha$ being the angle between the ON radius-vector and the OY vector or vertical plane passing through the longitudinal core axis.

To achieve proper correction, the turns must be positioned on the annular core in a non-radial manner such that $N_{3v}$ changes from positive to negative between back and front of the vertical deflection winding. While these formulae define the field shapes in terms of conductor location at the back and at the front of the deflection yoke, the non-radial positioning of the conductors offers technical difficulties when applied to a toroidal core because of the required complexity of the winding-machine, and because of the non-radial pulling-forces to which the wire is subjected during the winding operation.

Although FIGS. 2 and 3 as well as the equations given for cumulative conductor distribution show a continuous pattern of wire distribution, it has been found that discontinuities which introduce an increase in the magnitude of the 7th and higher odd Fourier series coefficients do not affect the self-convergence or the coma effect.

Figure 4:
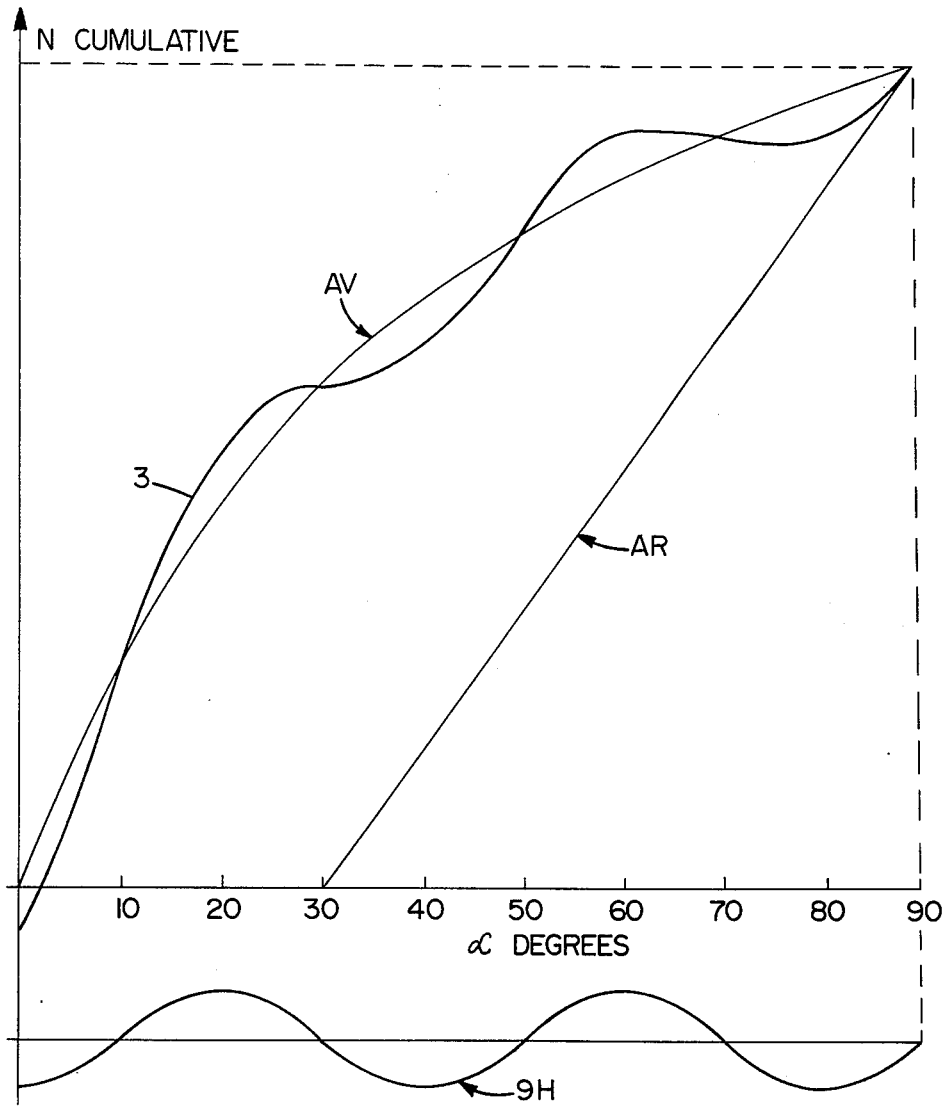
FIG. 4 shows a curve for the cumulative number of conductors as a function of angle for a quarter-section of a winding and shows an allowable deviation therefrom.
Figure 5:
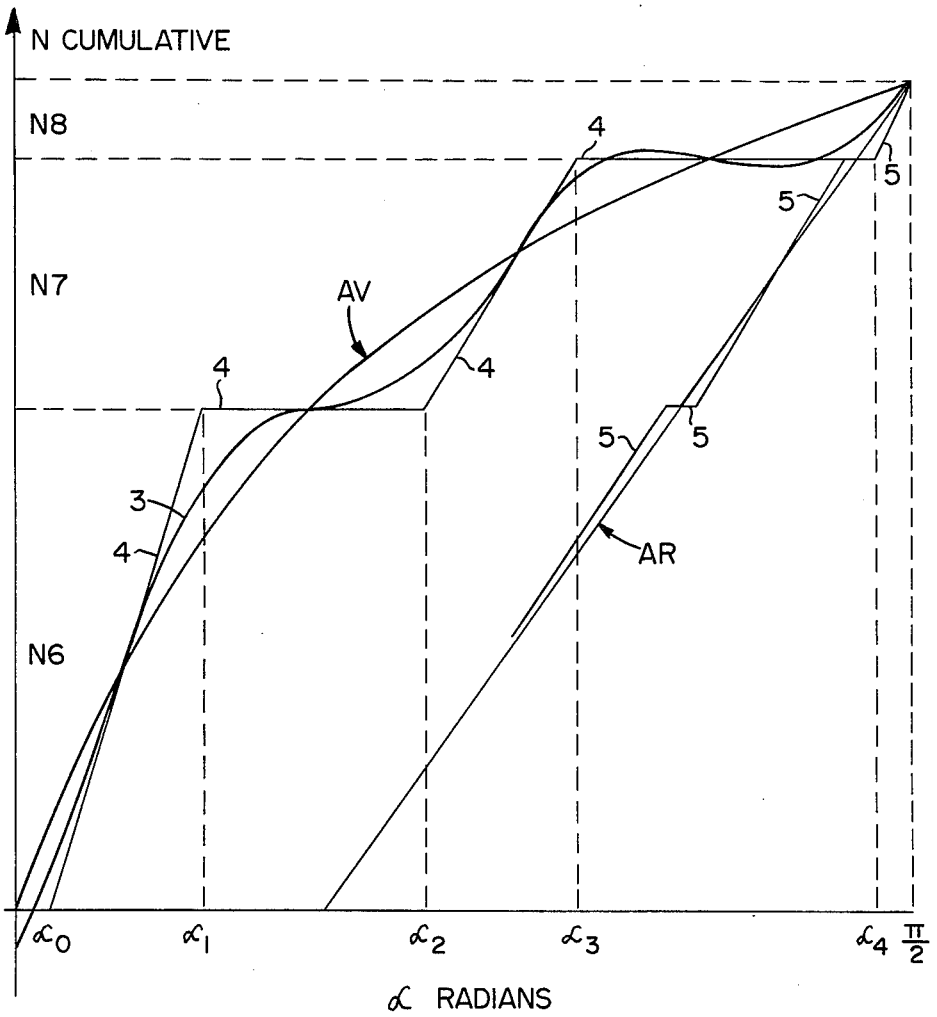
FIG. 5 shows an approximation method used for design of the winding of this invention.

Referring to FIG. 4, it is assumed that the cumulative sum of the conductors as a function of the angle has the shape of the curve designated AR for the back part of a quarter section of a vertical deflection winding and designated AV for the front part of the same winding. It is apparent that the Fourier series for the AR curve has a negative third harmonic term and the Fourier series for the AV curve has a positive third harmonic term. Introducing ninth harmonic discontinuities to the AV curve is illustrated by adding the curve designated 9H to the AV curve to obtain the curve designated 3. Referring to FIG. 5, the curve 3 described above may be approximated by lines designated 4. Specifically, lines 4 are horizontal for values of $\alpha$ ranging from $\alpha_1$ to $\alpha_2$ and from $\alpha_3$ to $\alpha_4$. Physically, the horizontal line segments represent no conductors located on the front of the core. For values of $\alpha$ ranging from $\alpha_0$ to $\alpha_1$, from $\alpha_2$ to $\alpha_3$ and from $\alpha_4$ to $\pi/2$, the cumulative sum of the conductors is a ramp function representing uniform distribution of conductors on the front of the ferrite core. Correspondingly, on the back of the deflection yoke, the curve AV may be approximated by lines designated 5, with the same explanation regarding its horizontal segments and ramp segments. Using the preceding approximations, winding operations may be easily performed on a toroid core by placing conductors in primary clusters or packages such that the conductors are positioned where the ramp functions occur in the approximations of the cumulative distribution curves. It is also apparent that the ramp functions and therefore the clusters of conductors are substantially located in ranges of $\alpha$ near 10°, 50° and 90° measured from a vertical plane through the longitudinal axis of the core.

Figure 6:
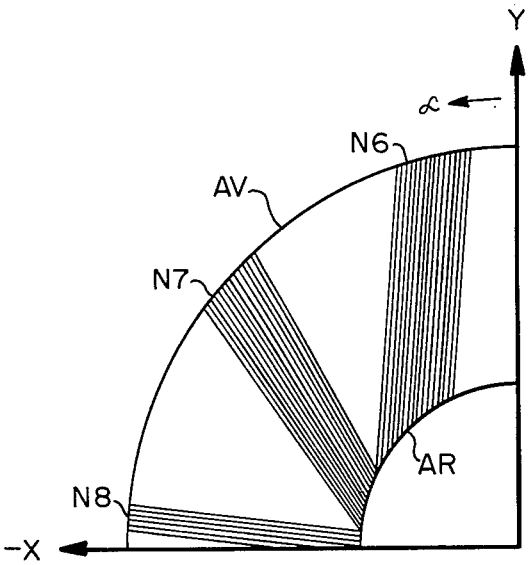
FIG. 6 is an end view of a quarter section of a first embodiment of a vertical deflection winding constructed in accordance with this invention.

Using the approximations of FIG. 5, a first embodiment of the winding may be realized by positioning three non-radial primary clusters of conductors on predetermined arcs of the quarter section of the core, as shown in FIG. 6 where the three primary clusters are designated N6, N7 and N8.

Figure 8:
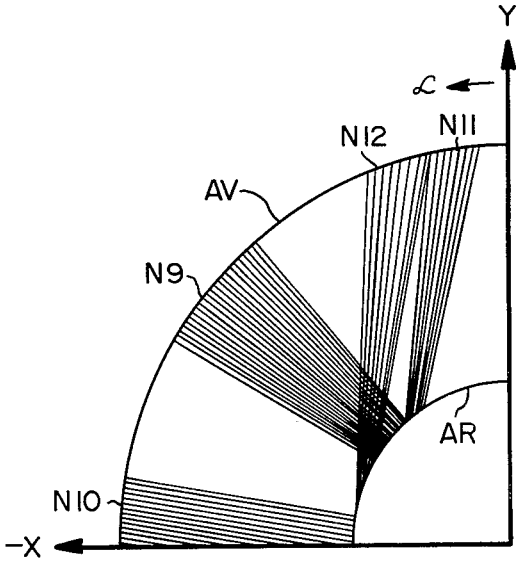
FIG. 8 is an end view of a quarter section of a second embodiment of a vertical deflection winding constructed in accordance with this invention.
Figure 7:
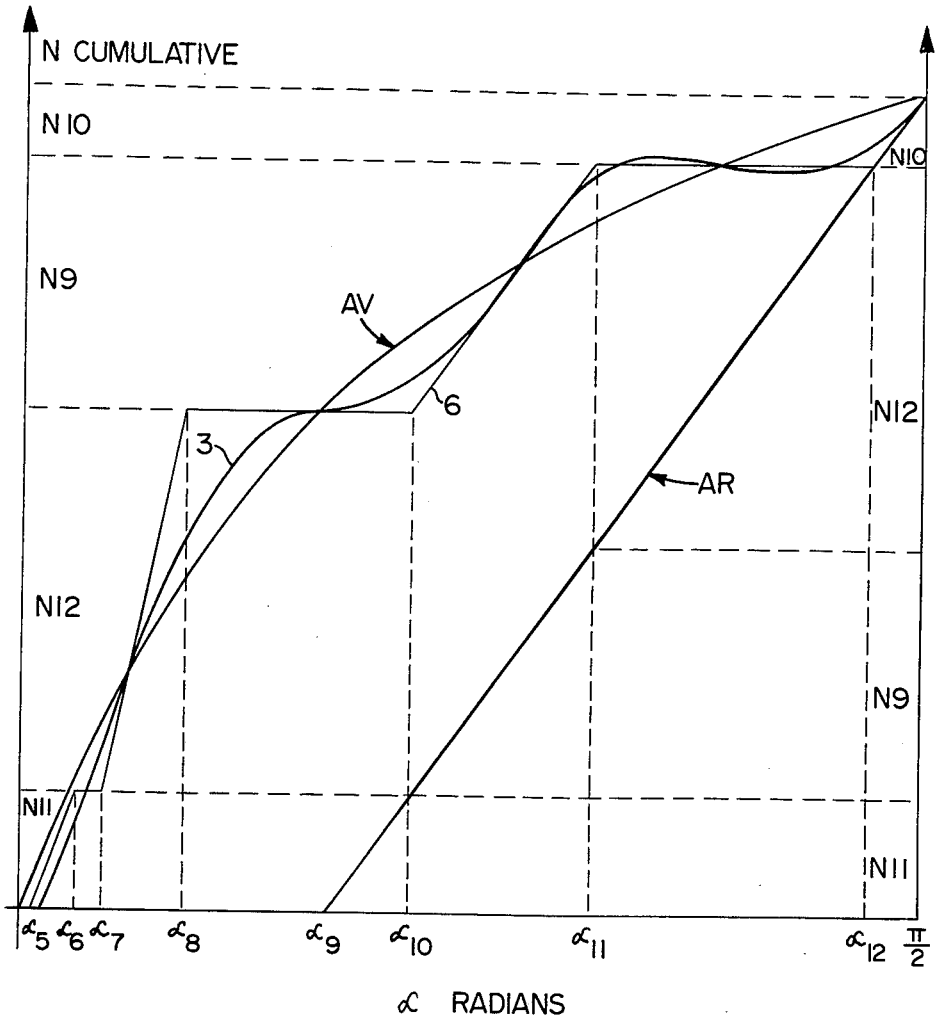
FIG. 7 shows a second approximation method used for design of the winding of this invention.

Because the winding of turns in a non-radial manner is more difficult than the winding in a radial manner, even in instances where the conductors are geometrically parallel in each cluster, a second approximation to curve 3 of FIG. 4 is useful as a means for realizing a second embodiment which minimizes the number of clusters which must be wound in a non-radial manner. Referring to FIG. 7 in which again a segmented curve 6 is used to approximate curve 3, it may be observed that two ramp segments of curve 6 are substantially parallel to curve AR for values of $\alpha$ ranging from $\alpha_{10}$ to $\alpha_{11}$ and from $\alpha_{12}$ to $\alpha/2$. In these ranges of $\alpha$, clusters may be wound on a toroid core in the classical radial manner. However, for values of $\alpha$ ranging from $\alpha_5$ to $\alpha_6$ and from $\alpha_7$ to $\alpha_8$, two clusters must be wound in a non-radial manner. Using the foregoing design procedure, four additional clusters must be wound as compared to the previous embodiment. However, for the entire toroid, the method requires four fewer non-radially wound clusters. The second embodiment is illustrated in FIG. 8 in which radial clusters N9 and N10 and non-radial clusters N11 and N12 are shown in end-view positioned on a quarter section of a frustrum-shaped core.

Figure 9:
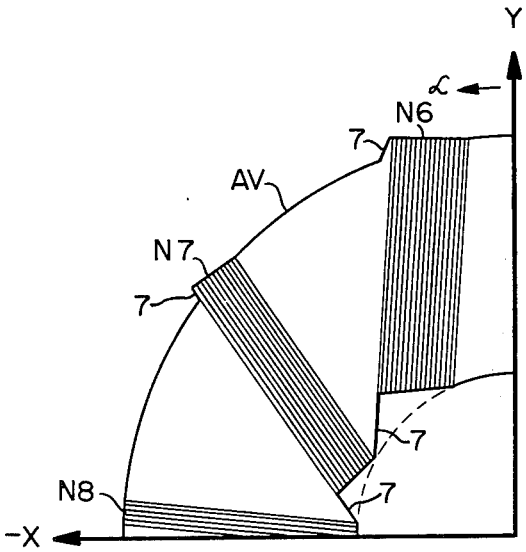
FIGS. 9 and 10 show means for achieving a definite location of the turns clusters in the first and second embodiments.
Figure 10:
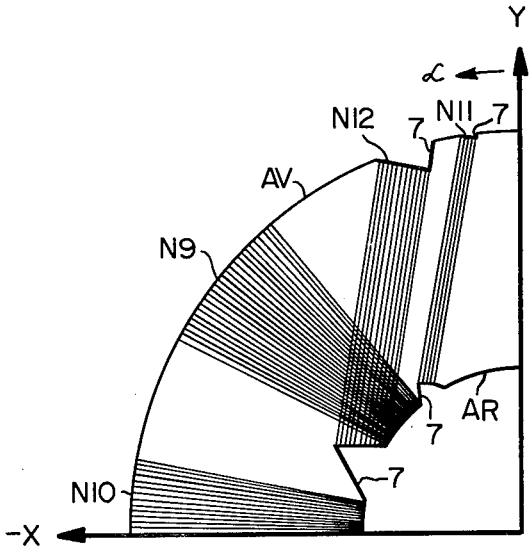

Referring again to FIGS. 6 and 8, it is seen that the positioning of non-radial clusters N6, N7, N8, N11 and N12 presents a difficult manufacturing problem because of the nonradial tension on the conductors. The manufacturing problem may be solved by providing cluster-positioning serrations 7 on the back and/or on the front edges of the core as indicated in FIGS. 9 and 10. Preferably, the serrations 7 should provide a surface perpendicular to the turns at the middle point of each cluster or sub-cluster, in order that the conductors will not slip during the winding operation, and in order that the width of each non-radial cluster may be maintained such that it has geometrically parallel conductors. It is noted that use of glue or self-adhering wire is not necessary using the method described herein. It is also noted in comparison of FIGS. 8 and 10 that the use of serrations 7 for cluster N12 results in a particularly apparent improvement in ease of manufacture using geometrically parallel turns. Cluster-positioning serrations 7 may be formed directly on the edge of the core or may be formed on a non-ferrous, cogged-crown ring positioned on an edge of said core.

A vertical deflection winding with three primary non-radial clusters has been constructed according to the first embodiment of this invention in which 48 conductors were used for cluster N6, 25 conductors for cluster N7 and 7 conductors for cluster N8. The clusters were connected in series, resulting in an inductance of 3.45 millihenries and a resistance of 3.25 ohms using 0.55 millimeter diameter copper wire. Cluster N6 was positioned at an angle of approximately 35° with respect to a generating line extending along the surface of the frustrumshaped core to the imaginary tip of the frustrum cone. Clusters N7 and N8 were positioned at angles of approximately 30° and 5°, respectively, with respect to the appropriate generating lines. Obviously, the values given for angular positioning pertain only to a particular dimension core. However, the numerical ratios of conductors positioned in each of the primary clusters will, in practice, remain at approximately 48, 25 and 7.

A second embodiment of this invention has been constructed according to the illustration of FIG. 10 in which 25 turns were used for cluster N9, 7 turns for cluster N10, 7 turns for cluster N11 and 41 turns for cluster N12. The clusters were connected in series, resulting in an inductance of 3.45 millihenries and a resistance of 3.25 ohms using 0.55 millimeter diameter copper wire. Clusters N11 and N12 both were positioned at an angle of approximately 60° with respect to generating lines of the core frustrum. Obviously, the values given for angular positioning pertain to a particular dimension core. However, the numerical ratio of conductors positioned in each of the primary clusters remains, as in the first embodiment, at approximately 48, 25 and 7 considering the fact that clusters N11 and N12 are sub-clusters corresponding to primary cluster N6 of the first embodiment. It is noted parenthetically that the configuration of the second embodiment requires that the conductors of at least one sub-cluster cross over conductors of a primary cluster in each quarter section.

A successful third embodiment has been constructed in which cluster N11 of the second embodiment was eliminated and the number of turns in cluster N12 was increased to 48, thereby decreasing the total number of non-radial windings to four.

While the embodiments described pertain to a vertical deflection winding, the construction procedures are equally applicable to horizontal deflection windings. It is also apparent that a vertical deflection winding constructed according to this invention may be used in a hybrid yoke designed for horizontal self-convergence and for coma effect correction. The saddle winding of the hybrid yoke may be constructed using clustered conductors in accordance with the teachings of this invention.

An additional advantage to the use of deflection coils wound in accordance with this invention is that current controlling elements can be electrically connected in parallel with individual clusters of conductors, making it possible to decrease the effects of some clusters and at the same time modify the magnetic field shape.

Yet another advantage of the deflection coils wound in accordance with this invention is that they can be wound around a ferrite core which is formed in an insulating material.

A further advantage is that the winding operation may be easily performed, even for the non-radial clusters, using classial winding methods. Although illustrative embodiments of the invention have been described herein with reference to accompanying drawings, it is to be understood that the invention is not limited to those precise embodiments, and that various changes and modifications may be effected thereby by one skilled in the art without departing from the scope or spirit of this invention.

What I claim is:

1. A vertical deflection winding for use with a large screen, color cathode ray tube having in-line guns and wide deflection angle, having an annular core with front and rear edges and having toroidally wound conductors symmetrically located about a vertical plane passing through the longitudinal axis of said core and symmetrically located about a horizontal plane passing through said longitudinal axis comprising three primary clusters of said conductors positioned on the front edge of each quarter section of said core on predetermined arcs substantially located at angles of 10°, 50° and 90° measured from said vertical plane, said primary clusters having respective conductor numerical ratios of substantially 48, 25 and 7, the conductors of said clusters being substantially uniformly distributed on said rear edge of said core over a range of substantially 30° to 90° measured from said vertical plane.

2. The vertical deflection winding of claim 1 in which all three of said primary clusters are non-radially wound.

3. The vertical deflection winding of claim 1 in which two of said primary clusters are radially wound and in which one of said primary clusters is non-radially wound.

4. The vertical deflection winding of claim 1 in which an edge of said core is provided with cluster-positioning serrations.

5. The vertical deflection winding of claim 4 in which said cluster-positioning serrations are formed on said edge.

6. The vertical deflection winding of claim 4 in which said cluster-positioning serrations are formed on a non-ferrous ring positioned on said edge.

7. The vertical deflection winding of claim 1 in which at least one of said primary clusters is comprised of at least two sub-clusters.

* * * * *